United States Patent [19]

Gatti

[11] Patent Number: 4,922,934

[45] Date of Patent: May 8, 1990

[54] ROTARY APPLICATOR DEVICE, PARTICULARLY FOR MASCARA

[75] Inventor: Angelo Gatti, Biassono, Italy

[73] Assignee: Roan S.p.A., Italy

[21] Appl. No.: 162,008

[22] Filed: Feb. 29, 1988

[30] Foreign Application Priority Data

Mar. 6, 1987 [IT] Italy ..... 19610 A/87

[51] Int. Cl.[5] ..... A45D 40/26

[52] U.S. Cl. ..... 132/218; 132/320; 401/4; 401/126; 401/129

[58] Field of Search ..... 132/320, 218; 401/4, 401/118, 121, 122, 126, 129

[56] References Cited

U.S. PATENT DOCUMENTS

| | | | |
|---|---|---|---|
| a2,823,401 | 2/1958 | O'Higgins | 401/4 |
| 2,847,692 | 8/1958 | Edelstone et al. | 401/4 |
| 3,337,901 | 8/1967 | Schefer et al. | 401/129 |
| 3,768,915 | 10/1973 | Spatz | 132/320 |
| 4,056,111 | 11/1977 | Mantelet | 132/218 |
| 4,397,326 | 8/1983 | Formica | 132/218 |
| 4,632,136 | 12/1986 | Kingsford | 132/218 |

FOREIGN PATENT DOCUMENTS

| | | | |
|---|---|---|---|
| 2585934 | 2/1987 | France | 401/129 |

*Primary Examiner*—John J. Wilson
*Assistant Examiner*—Frank A. LaViola, Jr.
*Attorney, Agent, or Firm*—Steinberg & Raskin

[57] ABSTRACT

A container, a cap to be screwed thereon, a stem carrying at one end a brush, and elastic or the like connected at one end to the cap and undergoing loading when the latter is unscrewed, and connected at its other end to a mobile member carrying the brush holder stem, there being provided linkages to transmit movement to the brush holder stem by way of the mobile member, controllable member which provides friction acting on the mobile member and arranged to allow the stem to move only when required, and a member arranged to prevent rotation of the mobile member during the unscrewing of the cap in order to allow loading of the elastic.

10 Claims, 2 Drawing Sheets

ROTARY APPLICATOR DEVICE, PARTICULARLY FOR MASCARA

BACKGROUND OF THE INVENTION

This invention relates to an applicator device, particularly for mascara and similar products, comprising a stem carrying at one end a brush or similar means.

With particular but not exclusive reference to the field of cosmetic products and mascara in particular, such as product is applied manually to the user's eyelashes by rotating the brush so that its bristles slide along the eyelashes.

This operation requires a fairly long time to complete, so that it sometimes becomes tedious. In addition, the continuous manual movement of the brush can lead to possible dripping of the mascara into the user's eye.

SUMMARY OF THE INVENTION

An object of the present invention is to provide an applicator device particularly for mascara, of the aforesaid type, which allows the beauty product to be automatically applied to the eyelashes in a simpler, faster and safer manner, by reducing the movements required of the user.

This and further objects which will be apparent to the expert of the art are attained by an applicator device comprising a stem carrying at one end a brush or similar application means and incorporating a container on which there can be screwed a cap which carries the stem with the application means and comprises elastic means connected at one end to the cap and undergoing loading when this latter is unscrewed, and connected at the other end to a mobile member connected to the brush holder stem, there being provided linkage to transmit movement to said stem by way of the mobile member, controllable friction means acting on the mobile member and arranged to allow the stem to move only when required, and engagement means arranged to keep the mobile member at rest during its unscrewing in order to load the elastic means. The elastic means comprise at least one spring, the upper end of which is connected to the cap and is entrained during the unscrewing of this latter by its engagement with a toothed wheel fixed to the interior of the top of the cap. The toothing of this toothed wheel is shaped in such a manner that the end of the spring engages the elements of the toothed wheel only during the unscrewing of the cap and not during its screwing down. This is obtained by teeth having differently inclined sides. The purpose of this is to avoid keeping the spring loaded for a lengthy period when the mascara is not being used.

The lower end of the spring engages in a recess rigid with the mobile member which operates the reduction gear.

Said mobile member is keyed onto a centering shaft and is driven by the return force of the spring only when a mobile substantially lever-shaped arm of the friction means is raised. Said raising is done by pressing a button which projects from the lateral surface of the cap, this action allowing the mobile arm to rotate about a fulcrum, resulting in a reduction in the friction effect or, if pushed completely down, in its separation from the surface of the mobile member.

The rotation of this latter results in movement of the constituent gearing of the linkage, which is preferably a reduction gear, and is arranged to rotate the brush holder stem which torsionally connected to the exit wheel of the reduction gear.

Said gearing comprises at least one planet gear carried by a pin mounted on a planet carrier and simultaneously engaging internal toothing of the mobile member and external toothing associated with the stem. The number of planet gears determines the size of the reduction ratio (at the brush end). In the case of more than one planet gear, these interact during their movement with toothing on the planet carriers, so rotating them and finally, through successive reductions, rotating the stem.

Fixed to the lower part of the mobile member there are at least two friction elements which interact with the stem in order to slow down its rotation, and consequently delay the unloading of the spring.

Finally, there are provided temporary stop means typically in the form of cooperating splines or toothing to keep the mobile member at rest during the unscrewing of the cap, so allowing the spring to be loaded.

These temporary stop means have a double purpose in that besides enabling the spring to be loaded, they also act as a guide for the cap, to facilitate its mounting on the container. By means of the described device, comprising elastic means, mobile member, linkages, friction and locking means, automatic rotation of the brush holder stem is obtained. By varying the operating pressure on the button which projects through the cap and controls the lever-shaped friction means, the mobile arm is moved away to a greater or lesser extent from the mobile member, with consequent variation in the speed of rotation of the brush holder stem.

In all cases, with the device according to the invention a large number of revolutions (65-70) of the stem is obtained for a very small number (2 or 3) of turns of the device.

BRIEF DESCRIPTION OF THE DRAWINGS

The device of the present invention will be more apparent from the accompanying drawings in which.

DESCRIPTION OF THE PREFERRED EMBODIMENTS

Figure 1:
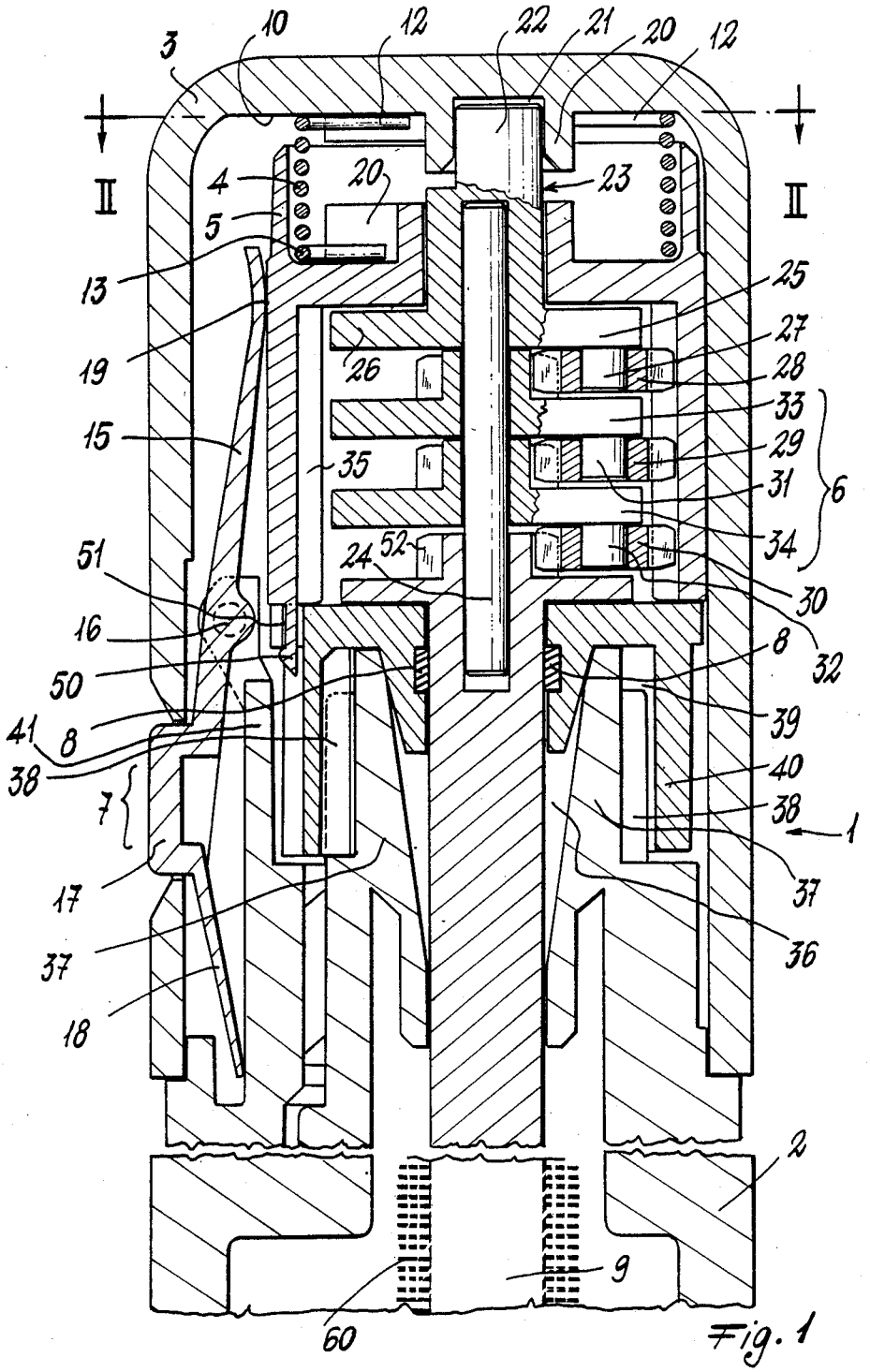
FIG. 1 is a section through the cap and part of the mascara bottle, showing the device of the present invention.
Figure 2:
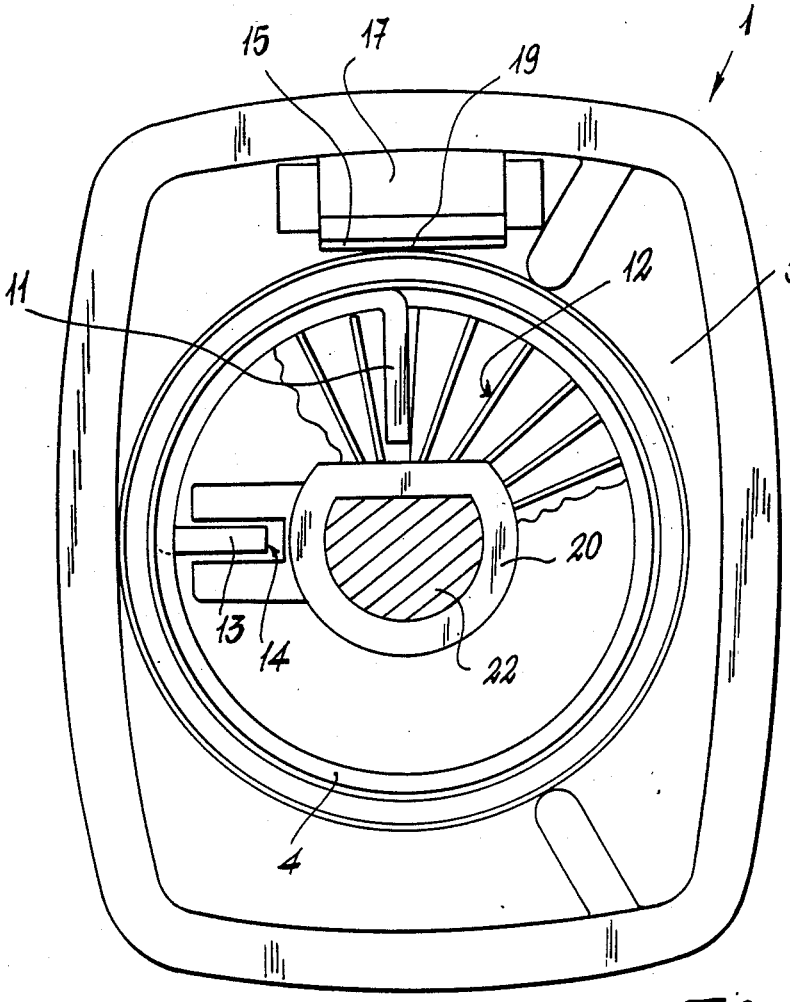
FIG. 2 is a section on the line II-II of FIG. 1.

With reference to the figures, a bottle, indicated overall by 1, comprises the mascara container 2 and cap 3.

Within the cap 3 there are provided elastic means consisting of one or more torsion springs 4, a mobile member 5, linkages 6 and friction means 7 and 8, which overall form a mechanism able to rotate a brush holder stem 9 under the control of a pushbutton 17. Specifically, the elastic means or spring 4 is provided inside the cap 3 and is connected to the inner surface 10 thereof. The radially bent upper end 11 of the spring engages in a recess provided in a toothed wheel 12 rigid with said surface 10 and is entrained by said wheel 12 during the unscrewing of the cap 3. This entrainment action does not however occur during the screwing down of the cap because the upper end 11 of the spring 4 slides, without engagement therein, over the toothing of the toothed wheel 12 as the teeth of its toothing have their sides differently inclined for this purpose. The other end 13 of the spring 4 is fixed in a recess 14 in the mobile member 5 which, as explained hereinafter, is moved by the return force of the spring 4 once the friction means 7 has been raised.

Said friction means 7 is in the form of a lever defined by an elastic mobile arm 15 pivoted at 16 to a part 41 rigid with the cap 3, and a pushbutton connected to a second elastic arm 18 which counteracts the action of the part 41. The mobile arm 15 is in contact with a region 19 of the mobile member 5 and in this region a friction force is generated (under the thrust of the other preloaded arm 18) able to block or release the rotation of the mobile member on command.

In a part 40, which closes the mobile member 5 with which it is rigid, there are provided further friction means 8 consisting typically of felt pads generating a certain friction against the brush holder stem 9, so as to slow down the speed of rotation.

In particular, the part 40 can be connected to the mobile member by snap-engagement of teeth 50 in seats 51.

In a projection on the upper inner surface 10 there is provided a seat 21 of substantially semicylindrical section, into which there is forced the upper end 22 of a member 23 located within the mobile member 5 and fixed onto a centering shaft 24, and comprising lowerly a flange 25 provided with an eccentric pin 27 on which there is idly mounted a planet gear 28 pertaining to the linkage 6, which in the described example comprises further planet gears 29 and 30 mounted on pins 31 and 32 of planet carrier elements 33 and 34 which are coaxial to each other and to the member 23 and are mounted idly on the shaft 24. Said linkage 6, preferably in the form of a reduction gear, is arranged to rotate the brush holder stem 9. The gears 28, 29, 20 are rotated by the internal axial toothing 35 of the mobile member 5 when this is made to rotate by the loaded spring 4. As the gears 29, 30 subsequent to the first gear 28 are rigid with the planet carrier elements, which are themselves separate, the said mechanical connection produces a multiplication in the number of revolutions undergone by the stem with respect to the number of revolutions undergone by the mobile member 5, this stem also being fixed onto the centering shaft 24 and provided with toothing 52 with which the last gear 30 engages to thus rotate the stem 9.

Said brush holder stem 9 penetrates through a bore 36 provided in the top of the mascara container 2. On the walls of said bore 36 there is provided a scraper element 37 to prevent the brush 60 fixed to the brush holder stem 9, from removing too much mascara from the container 2.

In proximity to said bore 36 there are axial teeth or splines 38 arranged to cooperate with corresponding recesses 39 located in the lower part 40 which closes the mobile member 5, so as to hold it still during the unscrewing of the cap 2. Said teeth or splines 38 thus enable the spring 4 to load and consequently store energy, which is released when the mobile arm 15 of the lever 7 is raised by pressing the pushbutton 17.

In studying the operation of the device it will be assumed that the cap 3 is being unscrewed from the container 2. During this procedure, the teeth or splines 38 cooperate with the recesses 39 present in the part 40, so keeping the mobile member 5 in a fixed position relative to the cap 3. At the same time, the upper end 11 of the spring 4 is dragged to follow the rotation of the cap 3 by virtue of its engagement with the toothing 12, whereas its lower end does not move due to it being rigid with the mobile member 5 which is still at rest, and thus the spring 4 loads. When the cap 3 has been separated from the container 2, the brush holder stem 9 is extracted from this latter causing the brush to rub against the scraper elements 37 and lose any excess mascara which has been picked up by it.

While the brush is being brought up to the eyelashes the stem, now free, does not rotate because the mobile member 5 is kept at rest by the friction generated in the contact region 19 between the mobile member 5 and mobile arm 15 of the lever 7.

When the brush has been brought into contact with the eyelashes, the pushbutton 17 is pressed and this action has the result of withdrawing the mobile arm 15 from the mobile member 5, so allowing this latter to rotate by virtue of the return force of the spring 4.

As the mobile member 5 rotates, its toothing 35 rotates the gears 28, 29, 30 which in their turn rotate the planet carrier elements 33 and 34 and the brush holder stem 9. By virtue of the particular mechanical linkage used, the number of revolutions which the stem is able to make is a multiple of the number of turns undergone initially by the mobile member 5, and passing for example from the 2 or 3 turns required to unscrew the cap 3 from the container to the 65–70 final revolutions which the brush holder stem is able to make.

Without separating the arm 15 from the mobile member 5 it is possible, by varying the pressure on the pushbutton 17, to reduce the friction force between the arm 15 and the mobile member 5 so as to also vary the speed of rotation of the mobile member 5 and thus, finally, of the brush holder stem.

In addition, the braking means 8 disposed in contact with the stem 9 enable its rotation speed to be further reduced.

When the spring has unloaded, the rotation of the stem 9 cases, and it can then be reinserted into the container 2 by screwing the cap on.

What I claim is:

1. An applicator device particularly for mascara and similar products, comprising a stem, carrying at one end a brush or similar protection means, characterized in that onto a container there can be screwed a cap which carries the stem with the application means and comprises elastic means connected at one end to the cap and being tensioned when the latter is unscrewed, and connected at the other end to a mobile member connected to the stem, there being provided linkages to transmit movements to said stem by way of the mobile member, controllable friction means acting on the mobile member and arranged to allow the stem to move only when required and to prevent return of the cap into an untensioned position when the cap is unscrewed, and engagement means arranged to keep the mobile member from transmitting movement to the stem during its unscrewing in order to tension the elastic means.

2. A device as claimed in claim 1, characterized in that the elastic means comprise at lest one torsionally operating spring secured at one end to the cap and at its other end to the mobile member.

3. A device as claimed in claim 2, characterized in that the spring is secured to the cap by a projection shaped in such as manner as to entrain only the end secured to the cap during the unscrewing of the cap.

4. A device as claimed in claim 2, characterized in that the end of the spring secured to the mobile member is fixed into a recess provided on the mobile member.

5. A device as claimed in claim 1 characterized in that the mobile member is fixed onto a centering shaft and comprises internally a projection arranged to transmit the motion of the member to gears constituting the linkage, the rotation of said member being prevented by friction means which are arranged to allow this latter to move only when desired.

6. A device as claimed in claim 5, characterized in that said friction means comprise a lever composed of elastic arms, a pushbutton being provided on one of the arms.

7. A device as claimed in claim 5, characterized in that the gears are planet gears carried by mutually separate planet carriers, of which one is fixed and the others are rotatable and which form a mechanical unit for stepping-down the movement of the mobile member which, by means of its projection engages the planet gears, the exit planet gear of which engages the stem.

8. A device as claimed in claim 1, characterized by comprising friction means associated with the mobile member and arranged to generate friction on the stem.

9. A device as claimed in claim 8, characterized in that the mobile member is arranged to rotate only axially during the unscrewing of the cap.

10. A device in accordance with claim 9, characterized in that a coupling which limits the freedom of the mobile member to only axial movement comprises axial projections cooperating with axial grooves, said projections and grooves being provided on the container and on the mobile member or visa versa respectively.

* * * * *